US008124220B2

(12) United States Patent
Poncelet et al.

(10) Patent No.: US 8,124,220 B2
(45) **Date of Patent: *Feb. 28, 2012**

(54) INKJET RECORDING ELEMENT

(75) Inventors: Olivier J. Poncelet, Chalon sur Saone (FR); Stephanie V. Desrousseaux, Ouroux sur Saone (FR)

(73) Assignee: Eastman Kodak Company, Rochester, NY (US)

( * ) Notice: Subject to any disclaimer, the term of this patent is extended or adjusted under 35 U.S.C. 154(b) by 2296 days.

This patent is subject to a terminal disclaimer.

(21) Appl. No.: 10/521,898

(22) PCT Filed: Jul. 14, 2003

(86) PCT No.: PCT/EP03/07577

§ 371 (c)(1),
(2), (4) Date: Jan. 14, 2005

(87) PCT Pub. No.: WO2004/009368

PCT Pub. Date: Jan. 29, 2004

(65) Prior Publication Data

US 2005/0253916 A1 Nov. 17, 2005

(30) Foreign Application Priority Data

Jul. 18, 2002 (FR) ..... 02 09084

(51) Int. Cl.
*B41M 5/00* (2006.01)
*B44C 1/17* (2006.01)
*G03G 7/00* (2006.01)

(52) U.S. Cl. ..... 428/195.1; 423/328.1; 502/240; 528/9; 528/39

(58) Field of Classification Search ..... 428/195.1; 423/328.1, 330.1, 326, 329.1; 502/240, 241, 502/242, 243, 246, 250, 254, 258, 263; 528/9, 528/39

See application file for complete search history.

(56) References Cited

U.S. PATENT DOCUMENTS

| | | | | |
|---|---|---|---|---|
| 5,888,711 | A * | 3/1999 | Poncelet et al. | 430/527 |
| 5,916,946 | A * | 6/1999 | Poncelet et al. | 524/430 |
| 6,254,845 | B1 * | 7/2001 | Ohashi et al. | 423/328.1 |
| 6,548,149 | B1 * | 4/2003 | Liu et al. | 428/195.1 |
| 2002/0085972 | A1 * | 7/2002 | Poncelet | 423/328.1 |
| 2005/0238559 | A1 * | 10/2005 | Poncelet et al. | 423/328.1 |
| 2006/0165921 | A1 * | 7/2006 | Friour et al. | 428/32.34 |
| 2007/0054069 | A1 * | 3/2007 | Friour et al. | 428/32.34 |
| 2008/0097063 | A1 * | 4/2008 | Friour et al. | 528/9 |

FOREIGN PATENT DOCUMENTS

EP 1120281 A1 8/2001

* cited by examiner

*Primary Examiner* — Mark Ruthkosky
*Assistant Examiner* — David J Joy
(74) *Attorney, Agent, or Firm* — Andrew J. Anderson

(57) ABSTRACT

An ink jet recording element having very good dye keeping properties in time. The recording element comprises a support and at least one ink-receiving layer, the ink-receiving layer comprising at least one hydrosoluble binder and at least one aluminosilicate polymer obtained by a preparation method consisting in treating an aluminum halide with a mixture of at least one silicon alkoxide only having hydrolyzable substituents and at least one silicon alkoxide having a non-hydrolyzable substituent, with an aqueous alkali in the presence of silanol groups, the aluminum concentration being maintained less than 0.3 mol/l, the Al/Si molar ratio being maintained between 1 and 3.6 and the alkali/Al molar ratio being maintained between 2.3 and 3; and then stirring the resulting mixture at a temperature of from 15° C. to 35° C. in the presence of silanol groups for long enough to form the hybrid aluminosilicate polymer.

24 Claims, 10 Drawing Sheets

INKJET RECORDING ELEMENT

FIELD OF THE INVENTION

The present invention relates to an ink jet recording element.

DESCRIPTION RELATIVE TO THE PRIOR ART

Digital photography has been growing fast for several years; the general public now having access to efficient and reasonably priced digital cameras. Therefore people are seeking to be able to produce photographic prints from a simple computer and its printer, with the best possible quality.

Many printers, especially those linked to personal office automation, use the inkjet printing technique. There are two major families of inkjet printing techniques: continuous jet and drop-on-demand.

Continuous jet is the simpler system. Pressurized ink ($3.10^5$ Pa) is forced to go through one or more nozzles so that the ink is transformed into a flow of droplets. In order to obtain the most regular possible sizes and spaces between drops, regular pressure pulses are sent using for example a piezoelectric crystal in contact with the ink with high frequency (up to 1 MHz) alternating current (AC) power supply. So that a message can be printed using a single nozzle, every drop must be individually controlled and directed. Electrostatic energy is used for this: an electrode is placed around the ink jet at the place where drops form. The jet is charged by induction and every drop henceforth carries a charge whose value depends on the applied voltage. The drops then pass between two deflecting plates charged with the opposite sign and then follow a given direction, the amplitude of the movement being proportional to the charge carried by each of the plates. To prevent other drops from reaching the paper, they are left uncharged: so, instead of going to the support they continue their path without being deflected and go directly into a container. The ink is then filtered and can be reused.

The other category of inkjet printer is drop-on-demand (DOD). This constitutes the base of inkjet printers used in office automation. With this method, the pressure in the ink cartridge is not maintained constant but is applied when a character has to be formed. In one widespread system there is a row of 12 open nozzles, each of them being activated with a piezoelectric crystal. The ink contained in the head is given a pulse: the piezo element contracts with an electric voltage, which causes a decrease of volume, leading to the expulsion of the drop by the nozzle. When the element resumes its initial shape, it pumps in the reservoir the ink necessary for new printings. The row of nozzles is thus used to generate a column matrix, so that no deflection of the drop is necessary. One variation of this system consists in replacing the piezoelectric crystals by small heating elements behind each nozzle. The drops are ejected following the forming of bubbles of solvent vapor. The volume increase enables the expulsion of the drop. Finally, there is a pulsed inkjet system in which the ink is solid at ambient temperature. The print head thus has to be heated so that the ink liquefies and can print. This enables rapid drying on a wider range of products than conventional systems.

There now exist new "inkjet" printers capable of producing photographic images of excellent quality. However, they cannot supply good proofs if inferior quality printing paper is used. The choice of printing paper is fundamental for the quality of obtained image. The printing paper must combine the following properties: high quality printed image, rapid drying after printing, good dye keeping in time, smooth appearance and high gloss.

In general, the printing paper comprises a support coated with one or more layers according to the properties required. It is possible, for example, to apply on a support a primary attachment layer, an absorbent layer, an ink fixing layer and a protective layer or surface layer to provide the glossiness of the recording element. The absorbent layer absorbs the liquid part of the water-based ink composition after creation of the image. Elimination of the liquid reduces the risk of ink migration to the surface. The ink fixing layer prevents any ink loss into the fibers of the paper base to obtain good color saturation while preventing excess ink that would encourage the increase in size of the printing dots and reduce the image quality. The absorbent layer and fixing layer can also constitute a single ink-receiving layer ensuring both functions. The protective layer is designed to ensure protection against fingerprints and the pressure marks of the printer feed rollers. The ink-receiving layer usually comprises a binder, a receiving agent and various additives. The purpose of the receiving agent is to fix the dyes in the printing paper. The best-known inorganic receivers are colloidal silica or boehmite. For example, the European Patent Applications EP-A-976,571 and EP-A-1,162,076 describe recording elements in which the ink-receiving layer contains as inorganic receivers Ludox™ CL (colloidal silica) marketed by Grace Corporation or Dispal™ (colloidal boehmite) marketed by Sasol. However, printing paper comprising an ink-receiving layer containing such inorganic receivers can have poor image stability in time, which is demonstrated by a loss of color density.

To meet the new requirements of the market in terms of photographic quality, printing speed and color stability, it is necessary to offer a new ink jet recording element having the properties as defined above, more particularly good dye keeping in time as well as a high gloss.

SUMMARY OF THE INVENTION

The new ink jet recording element according to the present invention comprises a support and at least one ink-receiving layer, and is characterized in that said ink-receiving layer comprises at least one hydrosoluble binder and at least one hybrid aluminosilicate polymer obtainable by a preparation method that comprises the following steps:

a) treating a mixed aluminum and silicon alkoxide of which the silicon has both hydrolyzable substituents and a non-hydrolyzable substituent, or a mixed aluminum and silicon precursor resulting from the hydrolysis of a mixture of aluminum compounds and silicon compounds only having hydrolyzable substituents and silicon compounds having a non-hydrolyzable substituent, with an aqueous alkali, in the presence of silanol groups, the aluminum concentration being maintained at less than 0.3 mol/l, the Al/Si molar ratio being maintained between 1 and 3.6 and the alkali/Al molar ratio being maintained between 2.3 and 3;

b) stirring the mixture resulting from step a) at ambient temperature in the presence of silanol groups long enough to form the hybrid aluminosilicate polymer; and c) eliminating the byproducts formed during steps a) and b) from the reaction medium.

Throughout the present description, the expression "non-hydrolyzable substituent" means a substituent that does not separate from the silicon atom during the process and in particular at the time of treatment with the aqueous alkali.

Such substituents are for example hydrogen, fluoride or an organic group. On the contrary, the expression "hydrolyzable substituent" means a substituent eliminated by hydrolysis in the same conditions.

In the following, the expression "modified mixed aluminum and silicon alkoxide" means a mixed aluminum and silicon alkoxide in which the aluminum atom only has hydrolyzable substituents and the silicon atom has both hydrolyzable substituents and a non-hydrolyzable substituent.

Similarly, the expression "modified mixed aluminum and silicon precursor" means a precursor obtained by hydrolysis of a mixture of aluminum compounds and silicon compounds only having hydrolyzable substituents and silicon compounds having a non-hydrolyzable substituent. This is the non-hydrolyzable substituent that will be found again in the hybrid aluminosilicate polymer material useful in the present invention.

More generally, an "unmodified" compound is a compound that only consists of hydrolyzable substituents and a "modified" compound is a compound that consists of a non-hydrolyzable substituent.

The ink jet recording element according to the present invention has improved dye keeping properties in time as well as a good gloss compared with the ink jet recording elements available on the market.

DETAILED DESCRIPTION OF THE INVENTION

Figure 1:
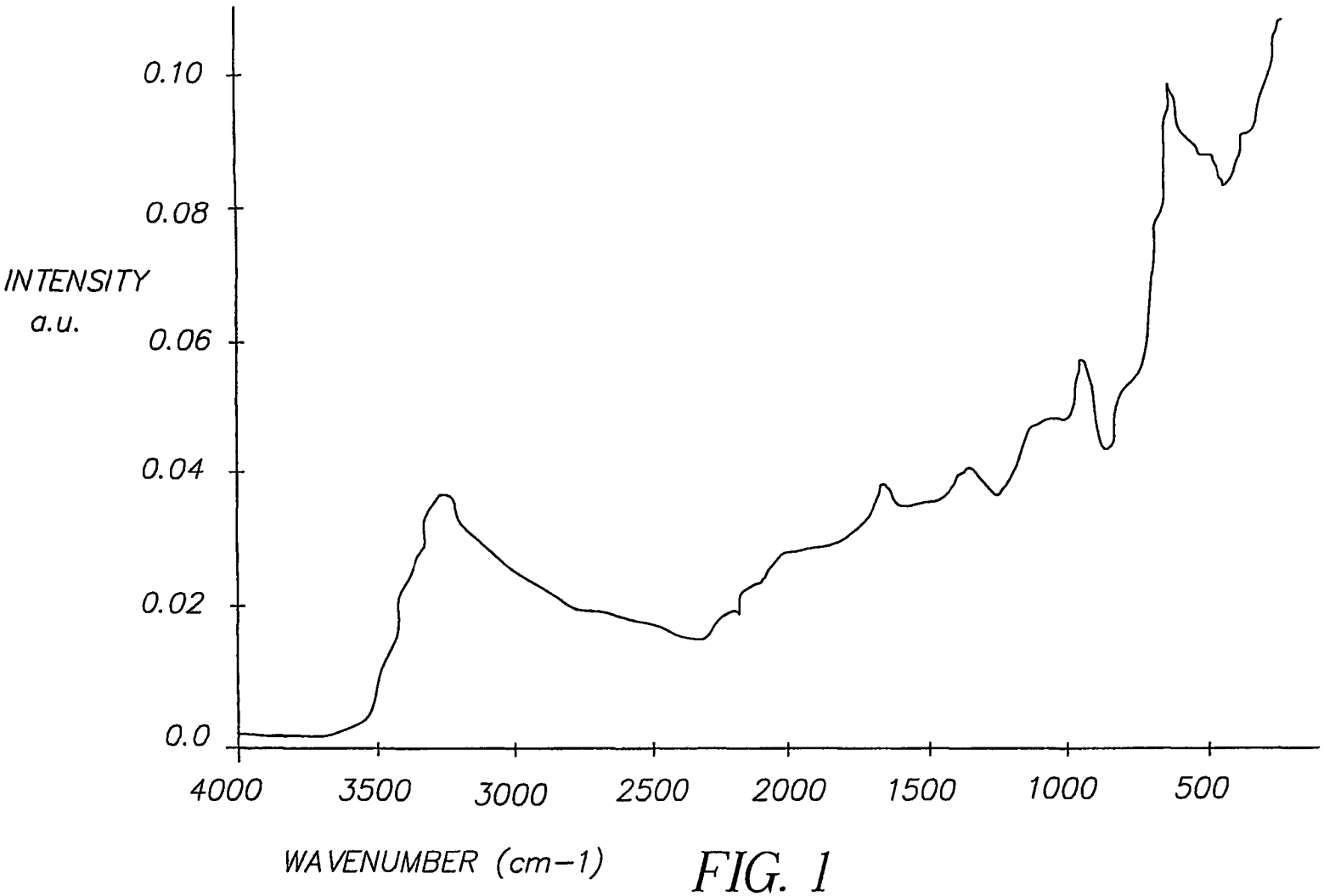
FIGS. 1 to 3 represent the spectra obtained by Raman spectroscopy of the aluminosilicate polymers used for comparative purposes and used in the present invention.

The ink jet recording element according to the present invention comprises firstly a support. This support is selected according to the desired use. It can be a transparent or opaque thermoplastic film; in particular a film based on polyester, polymethylmetacrylate, cellulose acetate, or polyvinyl chloride, and any other appropriate material. The support used in the invention can also be paper, both sides of which may be covered with a polyethylene layer. When the support comprising the paper pulp is coated on both sides with polyethylene, it is called Resin Coated Paper (RC Paper) and is marketed under various brand names. This type of support is especially preferred to constitute an inkjet recording element. The side of the support that is used can be coated with a very thin layer of gelatin or another composition to ensure the adhesion of the first layer on the support.

The ink jet recording element according to the invention then comprises at least one ink-receiving layer comprising at least one hydrosoluble binder. Said hydrosoluble binder can be gelatin or polyvinyl alcohol. The gelatin is that conventionally used in the photographic field. Such a gelatin is described in Research Disclosure, September 1994, No. 36544, part IIA. Research Disclosure is a publication of Kenneth Mason Publications Ltd., Dudley House, 12 North Street, Emsworth, Hampshire PO10 7DQ, United Kingdom. The gelatin can be obtained from SKW and the polyvinyl alcohol from Nippon Gohsei, or Air Product under the name Airvol® 130.

According to the present invention, the ink-receiving layer comprises, as receiving agent, at least one hybrid aluminosilicate polymer obtainable by a preparation method comprising the following steps:

a) treating a mixed aluminum and silicon alkoxide of which the silicon has both hydrolyzable substituents and a non-hydrolyzable substituent, or a mixed aluminum and silicon precursor resulting from the hydrolysis of a mixture of aluminum compounds and silicon compounds only having hydrolyzable substituents and silicon compounds having a non-hydrolyzable substituent, with an aqueous alkali, in the presence of silanol groups, the aluminum concentration being maintained at less than 0.3 mol/l, the Al/Si molar ratio being maintained between 1 and 3.6 and the alkali/Al molar ratio being maintained between 2.3 and 3;

b) stirring the mixture resulting from step a) at ambient temperature in the presence of silanol groups long enough to form the hybrid aluminosilicate polymer, and c) eliminating the byproducts formed during steps a) and b) from the reaction medium.

According to one embodiment, the modified mixed aluminum and silicon precursor can be formed in situ by mixing in aqueous medium (i) one compound selected from the group consisting of aluminum salts, aluminum alkoxides and aluminum halogenoalkoxides and (ii) at least one compound selected from the group consisting of unmodified silicon alkoxides and chloroalkoxides, and (iii) at least one compound selected from the group consisting of modified silicon alkoxides and chloroalkoxides.

The modified or unmodified alkoxide radical of the aluminum compound or silicon compound preferably contains 1 to 5 carbon atoms, such as methoxide, ethoxide, n-propoxide, or i-propoxide.

Preferably, an aluminum salt is used, such as a halide (e.g. chloride or bromide), a perhalogenate, a sulfate, a nitrate, a phosphate or a carboxylate. An aluminum halide, such as chloride, is particularly preferred.

Preferably, silicon compounds are used in the form of alkoxides.

A single unmodified silicon alkoxide or a mixture of unmodified silicon alkoxides, or a single unmodified silicon chloroalkoxide or a mixture of unmodified silicon chloroalkoxides, or a mixture of unmodified silicon alkoxides and chloroalkoxides can be used. Similarly, a single modified silicon alkoxide or a mixture of modified silicon alkoxides, or a single modified silicon chloroalkoxide or a mixture of modified silicon chloroalkoxides, or a mixture of modified silicon alkoxides and chloroalkoxides can be used.

Preferably, a mixture (i) of an aluminum halide and (ii) a mixture with at least one unmodified silicon alkoxide and at least one modified silicon alkoxide is produced.

An unmodified silicon alkoxide can be represented by the formula $Si—(OR)_4$, and a modified silicon alkoxide can be represented by the formula $R'—Si—(OR)_3$, wherein R represents an alkyl group comprising 1 to 5 carbon atoms R' represents H, F, or a substituted or unsubstituted linear or ramified alkyl or alkenyl group, comprising 1 to 8 carbon atoms, e.g. a methyl, ethyl, n-propyl, n-butyl, 3-chloropropyl group, or a vinyl group.

Preferably, the unmodified silicon alkoxide is tetramethyl or tetraethyl orthosilicate, and the modified silicon alkoxide is methyltriethoxysilane or vinyltriethoxysilane.

The ratio of unmodified silicon alkoxide to modified silicon alkoxide is between 0.1 and 10 in moles of silicon, and is preferably about 1.

In practice, the unmodified silicon alkoxide and modified silicon alkoxide mixture is first produced pure or diluted in a co-solvent such as an alcohol. Said alcohol is preferably ethanol, used in sufficient amount to obtain a clear homogeneous mixture once the silicon compounds are mixed with the aluminum compound. Then, this mixture is added to the aluminum salt in aqueous solution, with stirring, at ambient temperature between 15° C. and 35° C., preferably between 20° C. and 25° C., until a clear homogeneous mixture is obtained. A modified mixed aluminum and silicon precursor is thus obtained. The stirring time varies from 10 to 240 minutes, and is preferably 120 minutes.

According to step a) of the method for preparing the hybrid aluminosilicate polymer useful in the present invention, the precursor or a modified mixed aluminum and silicon alkoxide is then put in contact with an aqueous alkali, the aluminum concentration being maintained at less than 0.3 mol/l, the Al/Si molar ratio being maintained between 1 and 3.6, and the alkali/Al molar ratio being maintained between 2.3 and 3. Advantageously, the aluminum concentration is between $1.4\times10^{-2}$ and 0.3 mol/l and even more preferably between $4.3\times10^{-2}$ and 0.3 mol/l. Preferably, the Al/Si molar ratio is between 1 and 2.

Preferably, an aqueous solution of sodium, potassium or lithium hydroxide, diethylamine or triethylamine with a concentration between 0.5 M and 3 M, and preferably 3 M is used. The alkali can also be in the form of an hydroalcoholic solution.

The alkali is added to the precursor or to the modified mixed aluminum and silicon alkoxide at a rate preferably between 50 and 650 mmoles/hour.

The alkali in step a) is added in the presence of silanol groups. These groups can be supplied by glass or silica (glass wool) particles or beads, which have superficial hydroxy groups. When the volume of liquid to be treated is large, it may be desirable to increase the quantity of beads. The diameter of the beads can be between 0.2 and 5 mm and preferably between 1 and 3 mm. To simplify the implementation of the method for preparing the hybrid aluminosilicate polymer useful in the present invention, the preparation of the mixed aluminum and silicon precursor can also be performed in the presence of silanol groups, for example by circulating the mixture in a bed of glass beads.

After the addition of the alkali, step b) of the method for preparing the hybrid aluminosilicate polymer useful in the present invention consists in stirring the mixture resulting from step a) at ambient temperature in the presence of silanol groups long enough to form the said hybrid aluminosilicate polymer.

Then, step c) of the method for preparing the hybrid aluminosilicate polymer useful in the present invention consists in eliminating from the reaction medium the byproducts formed during steps a) and b), such as the residual ions coming essentially from the alkali used in step a). The residual ions can be eliminated by washing, by successive sedimentation or by diafiltration. The hybrid aluminosilicate polymer material resulting from step c) can then be concentrated by centrifugation or nanofiltration. The introduction of non-hydrolyzable substituents, such as organic functions, enables providing for example an organophilic character to the resulting hybrid aluminosilicate polymers.

In a first embodiment of the method for preparing the hybrid aluminosilicate polymer useful in the present invention, during step a) a quantity of alkali is added in order to obtain an alkali/Al molar ratio of about 2.3. In this case the pH is maintained between 4 and 5, and preferably between 4.2 and 4.3. Then step b) as described above is applied. The hybrid aluminosilicate polymer useful in the present invention is thus obtained as a dispersion. Step c) to eliminate the residual ions can then be performed by diafiltration, followed by nanofiltration concentration.

In a second embodiment of the method for preparing the hybrid aluminosilicate polymer useful in the present invention, during step a) a quantity of alkali is added in order to obtain an alkali/Al molar ratio of about 3. Then step b) as described above is applied. The hybrid aluminosilicate polymer useful in the present invention is thus obtained as a suspension. Step c) to eliminate the residual ions can then be performed by diafiltration, followed by nanofiltration concentration, the hybrid alumino silicate polymer having been previously redispersed by adding acid, such as hydrochloric or acetic acid or a mixture thereof.

In a third embodiment, the method for preparing the hybrid aluminosilicate polymer useful in the present invention comprises an additional step d), after step b) and before step c). Said step d) consists in adding in a few minutes an additional quantity of aqueous alkali to reach an alkali/Al molar ratio of 3 if this ratio had not already been reached during step a). The hybrid aluminosilicate polymer useful in the present invention is thus obtained in suspension form. Step c) to eliminate the residual ions can then be performed by diafiltration, followed by nanofiltration concentration, the hybrid aluminosilicate polymer having been previously redispersed by adding hydrochloric acid. Step c) can also be performed by washing with osmosed water by successive sedimentations, followed by centrifugation concentration.

The hybrid aluminosilicate polymer useful in the present invention resulting from step c) followed by concentration has physical gel form. The Al/Si molar ratio is between 1 and 3.6. Subsequent lyophilization enables the hybrid aluminosilicate polymer useful in the present invention to be obtained as a powder. Such a hybrid aluminosilicate polymer can be characterized in that its Raman spectrum comprises in spectral region 200 $cm^{-1}$ to 600 $cm^{-1}$ a wide band at 250±6 $cm^{-1}$, a wide intense band at 359±6 $cm^{-1}$, a shoulder at 407±7 $cm^{-1}$, and a wide band at 501±6 $cm^{-1}$, as well as bands corresponding to the silicon non-hydrolyzable substituent, wherein the bands linked to the silicon non-hydrolyzable substituent can be juxtaposed with other bands. The Raman spectrum is produced for the resulting hybrid aluminosilicate polymer after step b) and before step c) and lyophilized.

In another embodiment, the method for preparing the hybrid aluminosilicate polymer useful in the present invention comprises an additional step e), after step c), by which at least one chelating agent of aluminum is added to the hybrid aluminosilicate polymer resulting from step c). Then the mixture is stirred. Subsequent evacuation by vacuum enables the hybrid aluminosilicate polymer useful in the invention to be obtained in solid form.

Said chelating agent of aluminum can be selected from the group consisting of carboxylic acids, phosphonic acids, sulfonic acids, difunctional acids, their ester and anhydride components and amino acids. Preferably, the chelating agent of aluminum is selected from the group consisting of HCOOH, $R_1COOH$ wherein $R_1$ is selected from the group consisting of $CH_3(CH_2)_n$, n being between to 0 and 12, $CF_3$, $C_6H_5$, $(C_6H_5)_2$, substituted aromatic rings as in salicylic acid, $C_4H_4S$; $R_2PO(OH)_2$ wherein $R_2$ is selected from the group consisting of $CH_3$, $C_6H_5$; $R_3SO_3H$ wherein $R_3$ is $CH_3(CH_2)_n$, n being between to 0 and 5; $HOOC(CH_2)_nCOOH$, n=0-8; aromatic difunctional acids as phtalic acid; $HOOC(CH_2)_nPO(OH)_2$, n=2, 4; hydroxy aliphatic acids; $HOOC(CH_2OH)_nCOOH$, n=1-2; $CH_3CH(NH_2)COOH$. Preferably, the chelating agent is acetic acid.

The useful solvent of chelating agent of aluminum is generally water but another solvent miscible to water can be used in order to solubilize the chelating agent before its adding to the hybrid aluminosilicate polymer resulting from step c).

Step e) can be applied directly on the hybrid aluminosilicate polymer resulting from step c) to prepare a hybrid aluminosilicate polymer resulting from step e) or when a coating composition for the preparation of the ink-receiving layer is prepared by using a hybrid aluminosilicate polymer resulting from step c).

Step e) can comprise a first adding of acetic acid and a following adding of another different chelating agent of aluminum. This method is particularly useful to help the chelation when the chelating agent comprises large bulky groups.

The amount of chelating agent of aluminum in the ink-receiving layer corresponds to a molar ratio between the chelating functions of the chelating agent and aluminum of the hybrid aluminosilicate polymer, which can be greater than 0.1 and preferably comprised between 0.1 and 4.

The introduction of a chelating agent of aluminum allows to modify the surface of the hybrid aluminosilicate polymer by forming a chelate compound. The functional group of the chelating agent allows to increase the affinity of the hybrid aluminosilicate polymer with the medium in which it is used.

The Raman spectrum of the hybrid aluminosilicate polymer material resulting from step e) comprises the same bands as the hybrid aluminosilicate polymer material resulting from step b), as well as bands corresponding to the chelating agent in its chelate form.

The hybrid aluminosilicate polymer useful in the present invention resulting from step e) has physical gel form. The Al/Si molar ratio is between 1 and 3.6.

The ink-receiving layer comprises from 5 to 95 percent by weight of hybrid aluminosilicate polymer compared with the total weight of the dry state ink-receiving layer.

The present invention also relates to the composition intended to be coated on the support to constitute the ink-receiving layer of the recording element described above. To produce this composition, the hydrosoluble binder is diluted in water to adjust its viscosity and facilitate its coating. The composition then has the form of an aqueous solution or a dispersion containing all the necessary components. When the hybrid aluminosilicate polymer as described above is used for preparing the composition as a powder, this powder must be very fine.

The composition can also comprise a surfactant to improve its coating properties. The composition can be coated on the support according to any appropriate coating method, such as blade, knife or curtain coating. The composition is applied with a thickness between approximately 100 μm and 200 μm in the wet state. The composition forming the ink-receiving layer can be applied to both sides of the support. It is also possible to provide an antistatic or anti-winding layer on the back of the support coated with the ink-receiving layer.

The ink jet recording element according to the invention can comprise, besides the ink-receiving layer described above, other layers having another function, arranged above or below said ink-receiving layer. The ink-receiving layer as well as the other layers can comprise all the other additives known to those skilled in the art to improve the properties of the resulting image, such as UV ray absorbers, optical brightening agents, antioxidants, plasticizers, etc.

The ink-receiving layer useful in the present invention has a thickness generally between 5 μm and 50 μm in the dry state. The ink jet recording element comprising such an ink-receiving layer has improved dye keeping properties in time as well as gloss. It can be used for any type of inkjet printer as well as for all the inks developed for this technology.

The following examples illustrate the present invention without however limiting the scope.

1) Preparing Various Aluminosilicates

EXAMPLE 1

An aluminosilicate polymer in hollow sphere form was prepared according to the method described in U.S. Pat. No. 6,254,845.

Sodium orthosilicate was dissolved in purified water to obtain 50 ml of an aqueous solution at 0.1 mol/l. Separately, aluminum chloride was dissolved in purified water to obtain 67.15 ml of an aqueous solution at 0.1 mol/l. The aluminum chloride solution was mixed at high speed with the aqueous solution of sodium orthosilicate. At this stage, the aluminum concentration was $5.7\times10^{-2}$ mol/l. The Al/Si molar ratio was 1.34. The mixture was stirred for one hour at ambient temperature. A suspension was obtained that was filtered using a membrane filter to eliminate byproducts such as sodium chloride. The retentate that adhered to the filter was recovered, and 120 ml of purified water was added to it. The mixture was dispersed using ultrasound for one hour and then warmed for five days at 80° C., washed with purified water, and dried in normal conditions of temperature and pressure, and then lyophilized. An aluminosilicate polymer was obtained in hollow spherical particle form. This polymer was identified by its Raman signature or spectrum represented by FIG. 1.

In all the examples described, a Raman Bruker RFS 100 spectrometer (laser exciting wavelength, 1064 nm, power 800 mW and 512 scans) was used to obtain the Raman spectra. The spectra were acquired in reflection mode (180°) using a lens with semi-cylindrical mirror. Samples were analyzed in solid form (obtained by lyophilization) without special preparation. The Raman spectrum instead of infrared spectrum was preferred, because the materials used in the present invention were water rich and the infrared spectrum of the material was then masked by the water. This problem did not appear with the Raman spectra technology. Materials that have the same Raman signature belong to the same family.

EXAMPLE 2

Figure 2:
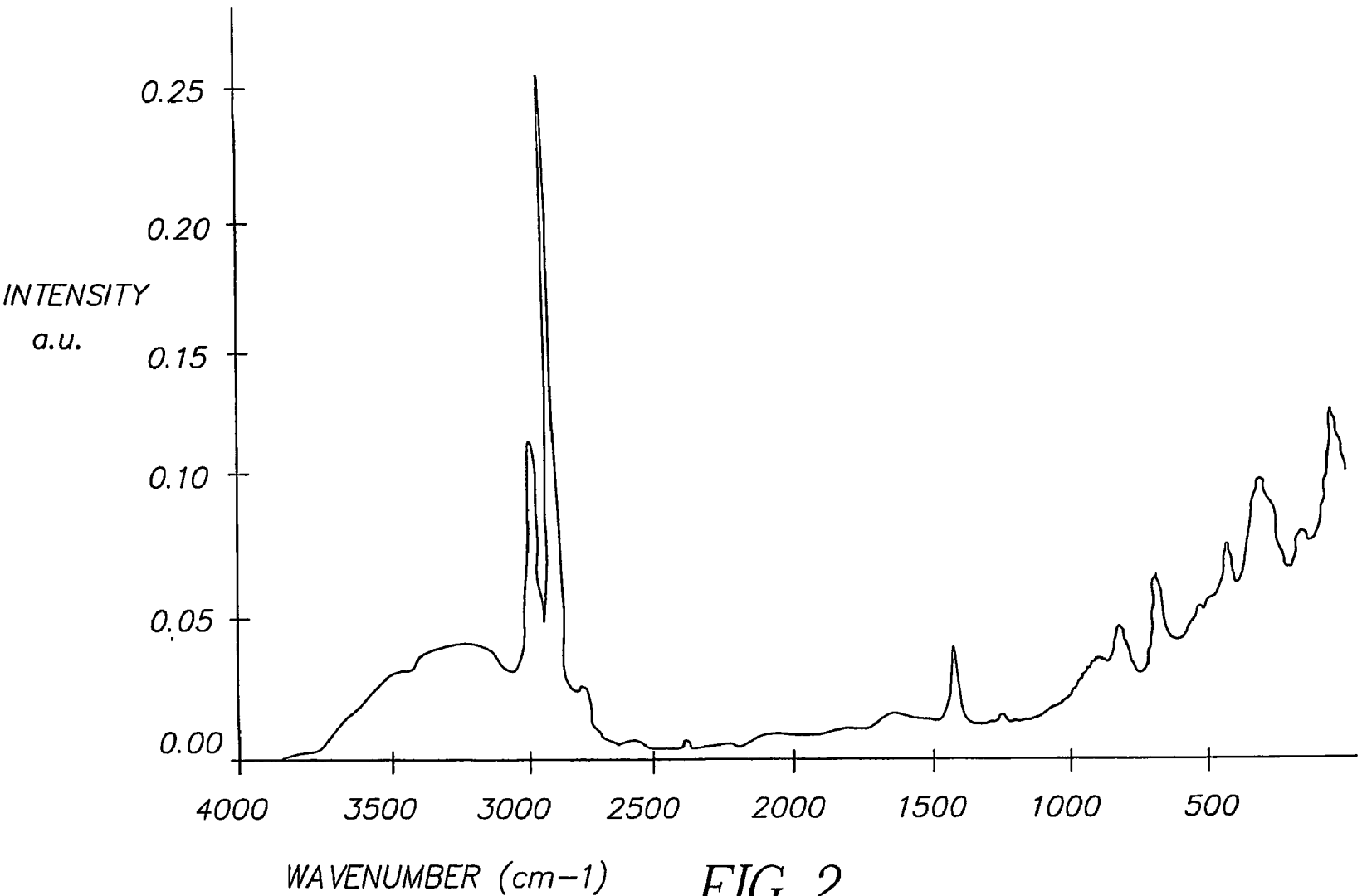

0.45 moles $AlCl_3$, $6H_2O$ were added to 10 l osmosed water. Separately, a mixture of tetraethyl orthosilicate and methyltriethoxysilane was prepared in a quantity corresponding to 0.25 moles silicon and so as to have a ratio of tetraethyl orthosilicate to methyltriethoxysilane of 1 in moles silicon. This mixture was added to the aluminum chloride solution. The resulting mixture was stirred and circulated simultaneously through a bed formed of 100 g glass beads 2-mm diameter using a pump with output 8 l/min. The operation of preparing the modified mixed aluminum and silicon precursor took 60 minutes. Then, according to step a) of the method for preparing the hybrid aluminosilicate polymer used in the present invention, 1.05 moles NaOH 3M were added in two hours. The reaction medium clouded. According to step b) of the preparation method, the mixture was stirred for 24 hours. The medium became clear. The circulation was stopped in the glass bead bed. Then, according to step d) of the preparation method, 0.3 moles NaOH 3M were added in five minutes. Aluminum concentration was $4.3\times10^{-2}$ mol/l, Al/Si molar ratio 1.8 and alkali/Al ratio 3. The hybrid aluminosilicate polymer useful in the present invention was thus obtained as a suspension. FIG. 2 represents the Raman spectrum of this polymer that was lyophilized to obtain its Raman signature.

Step c) of the preparation method consisted in leaving the resulting polymer suspension to settle for 24 hours, then in discarding the supernatant to recover the sediment. This sediment was washed with osmosed water by successive sedimentations to obtain a sodium level in the supernatant less than 10 ppm. Then the sediment was centrifuged to obtain a gel with about 4 percent by weight of hybrid aluminosilicate polymer. The resulting gel was lyophilized (20 mT, −50° C.) to obtain a solid of constant mass. The hybrid aluminosilicate polymer was thus obtained as a powder. The powder can be redispersed by adding water and acid, such as hydrochloric or acetic acid, and with mechanical stirring.

EXAMPLE 3

Figure 3:
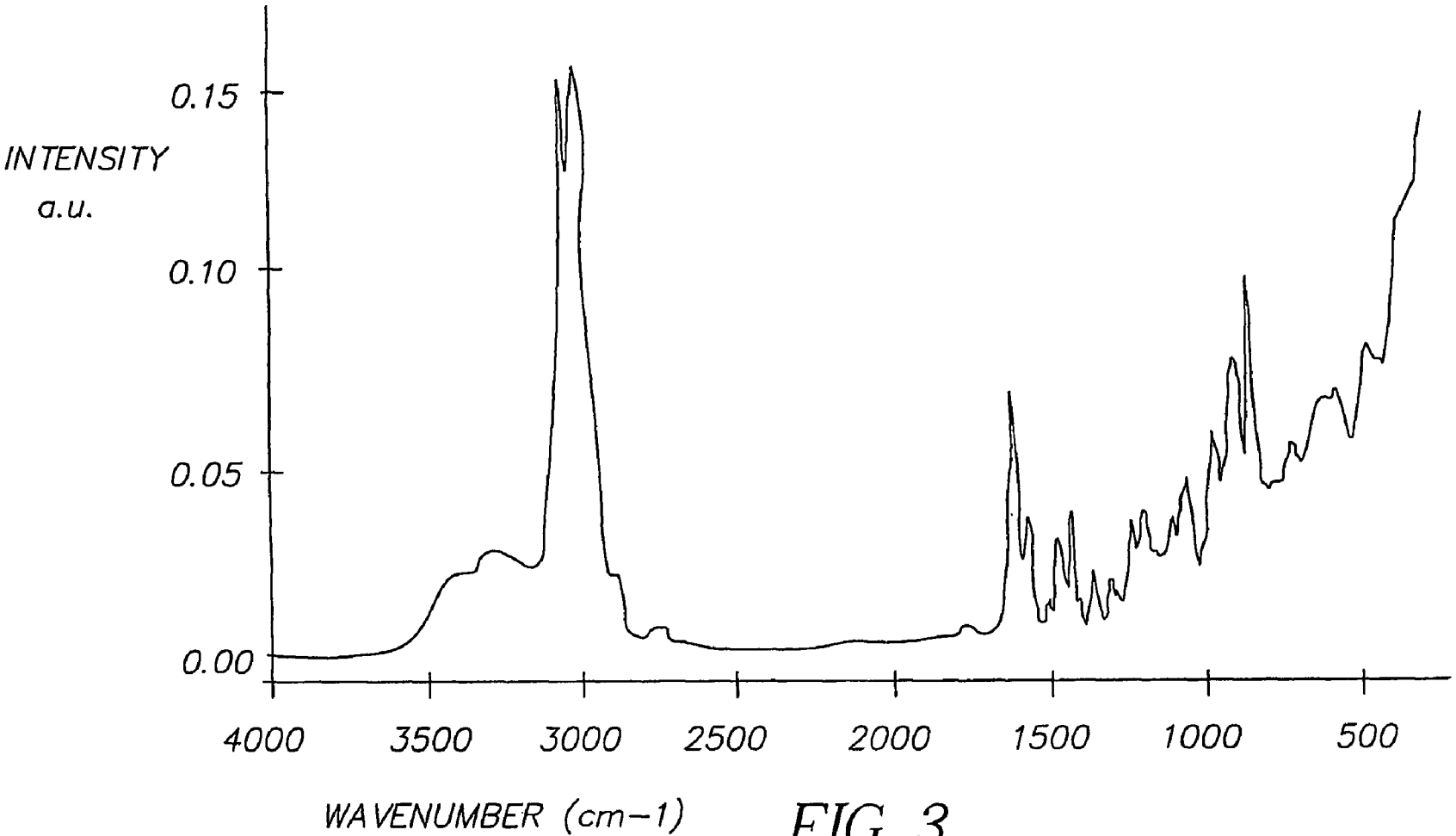

Example 2 was repeated using, for preparing the modified mixed aluminum and silicon precursor, a mixture of ethanol (3168 g), tetraethyl orthosilicate and 3-chloropropyltriethoxysilane in a quantity corresponding to 0.25 moles silicon and so as to have a tetraethyl orthosilicate/3-chloropropyltriethoxysilane ratio of 1 in moles silicon. FIG. 3 represents the Raman spectrum of this polymer that was lyophilized to obtain its Raman signature.

EXAMPLE 4

Example 2 was repeated using, for preparing the modified mixed aluminum and silicon precursor, a mixture of ethanol (44.6 g), tetraethyl orthosilicate and n-butyltrimethoxysilane in a quantity corresponding to 0.25 moles silicon and so as to have a tetraethyl orthosilicate/n-butyltrimethoxysilane ratio of 1 in moles silicon.

EXAMPLE 5

4.53 moles $AlCl_3$, $6H_2O$ were added to 100 l osmosed water. Separately, a mixture of tetraethyl orthosilicate and methyltriethoxysilane was prepared in a quantity corresponding to 2.52 moles silicon and so as to have a ratio of tetraethyl orthosilicate to methyltriethoxysilane of 1 in moles silicon. This mixture was added to the aluminum chloride solution. The resulting mixture was stirred and circulated simultaneously through a bed formed of 1 kg glass beads 2-mm diameter using a pump with output 8 l/min. The operation of preparing the modified mixed aluminum and silicon precursor took 120 minutes. Then, according to step a) of the method for preparing the hybrid aluminosilicate polymer, 10.5 moles NaOH 3M were added in four hours. Aluminum concentration was $4.3\times10^{-2}$ mol/l, Al/Si molar ratio 1.8 and alkali/Al ratio 2.31. The reaction medium clouded. According to step b) of the preparation method, the mixture was stirred for 48 hours. The medium became clear. The circulation was stopped in the glass bead bed. The hybrid aluminosilicate polymer used in the present invention was thus obtained as a dispersion. Step c) of the method according to the invention consisted in performing preconcentration by a factor of 3 by nanofiltration, then diafiltration using a Filmtec NF 2540 nanofiltration membrane (surface area 6 $m^2$) to eliminate the sodium salts to obtain an Al/Na rate greater than 100. The retentate resulting from the diafiltration by nanofiltration was concentrated to obtain a gel with about 20 percent by weight of hybrid aluminosilicate polymer used in the present invention.

EXAMPLE 6

15 moles $AlCl_3$, $6H_2O$, then 3.5 kg glass beads 2-mm diameter, were added to 75 l osmosed water. Separately, a mixture of tetraethyl orthosilicate and methyltriethoxysilane was prepared in a quantity corresponding to 8.34 moles silicon and so as to have a ratio of tetraethyl orthosilicate to methyltriethoxysilane of 1 in moles silicon. This mixture was added to the aluminum chloride solution. The resulting mixture was stirred vigorously. The operation of preparing the modified mixed aluminum and silicon precursor took 20 minutes to obtain a clear homogeneous medium. Then, according to step a) of the method for preparing the hybrid aluminosilicate polymer used in the present invention, 45 moles NaOH dissolved in 75 liters of osmosed water were added to the reaction medium, in 30 minutes. The reaction medium clouded. Aluminum concentration was 0.1 mol/l, Al/Si molar ratio 1.8 and alkali/Al ratio 3. According to step b) of the preparation method, the mixture was stirred for 15 minutes. The hybrid aluminosilicate polymer was thus obtained as a suspension. Step c) of the preparation method consisted in adding 676 g HCl 37 percent first diluted to 5 liters, and stirring for 150 minutes to obtain a dispersion of the hybrid aluminosilicate polymer. The dispersion was then diafiltrated using a Filmtec NF 2540 nanofiltration membrane (surface area 6 $m^2$) to eliminate the sodium salts to achieve an Al/Na ratio greater than 100. The retentate resulting from the diafiltration by nanofiltration was concentrated to obtain a gel with about 20 percent by weight of hybrid aluminosilicate polymer used in the present invention.

2) Preparation of Coating Compositions Constituting an Ink-Receiving Layer Coated on a Support As hydrosoluble binder polyvinylic alcohol (Gohsenol™ GH23 marketed by Nippon Gohsei) diluted 9 percent in osmosed water and as receiving agent the aluminosilicate polymers prepared according to examples 1 to 6 are used, as well as an aqueous dispersion of pyrogenated alumina (CAB-O-SPERSE® PG003 marketed by Cabot), an aqueous solution of colloidal silica (Ludox™ TMA marketed by Grace Corporation) and boehmite (Disperal™ HP 14/2 marketed by Sasol).

All the compositions result from mixing:

15.22 g water
3 g receiving agent (dry matter)
4 g polyvinylic alcohol.

When the receiving agent has powder form, the particles must first be crushed finely.

3) Preparation of Ink Jet Recording Elements

To do this, a Resin Coated Paper type support was placed on a coating machine, first coated with a very thin gelatin layer, and held on the coating machine by vacuum. This support was coated with a composition as prepared according to paragraph 2 using a spiral filmograph 125 μm thick. Then, it was left to dry overnight at ambient air temperature (21° C.).

The resulting recording elements correspond to the examples shown in Table I below giving the receiving agent used in the ink-receiving layer:

TABLE I

| Recording Element | Receiving agent in the ink-receiving layer |
|---|---|
| Ex 7 (comp.) | Aluminosilicate prepared according to Example 1 |
| Ex 8 (inv.) | Aluminosilicate prepared according to Example 2 |
| Ex 9 (inv.) | Aluminosilicate prepared according to Example 3 |
| Ex 10 (inv.) | Aluminosilicate prepared according to Example 4 |
| Ex 11 (inv.) | Aluminosilicate prepared according to Example 5 |
| Ex 12 (inv.) | Aluminosilicate prepared according to Example 6 |
| Ex 13 (comp.) | CAB-O-SPERSE ® PG003 |
| Ex 14 (comp.) | Ludox ™ TMA |
| Ex 15 (comp.) | Boehmite (Disperal ™ HP 14/2) |

4) Evaluating of Dye Keeping Properties in Time

To evaluate the dye keeping properties in time, a dye fading test by exposure to ozone was performed for each resulting recording element. To do this, targets, comprising four colors (black, yellow, cyan and magenta) were printed on each material using a Lexmark KODAK PPM 200 printer and related ink. The targets were analyzed using a Vannier-Photelec densitometer that measures the density of the various colors. Then the recording elements were placed to the dark in a room with controlled ozone atmosphere (60 ppb) for three weeks. Each week, any degradation of the color density was monitored using the densitometer. If density losses were less than 10 percent, for all the colors, it was considered that the material enables particularly stable printing to be obtained.

Figure 4:
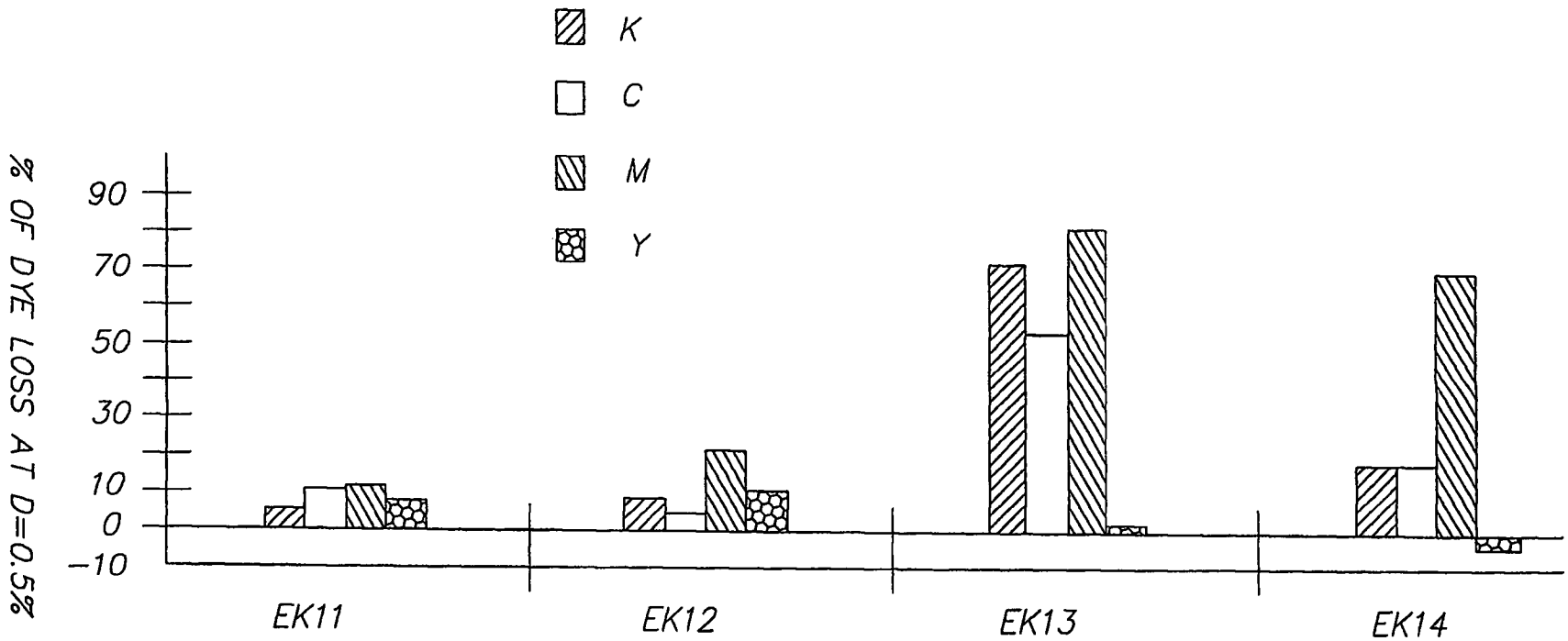
FIGS. 4 to 12 represent the percentage of color density loss for various comparative ink jet recording elements and according to the present invention when exposed to ozone.
Figure 5:
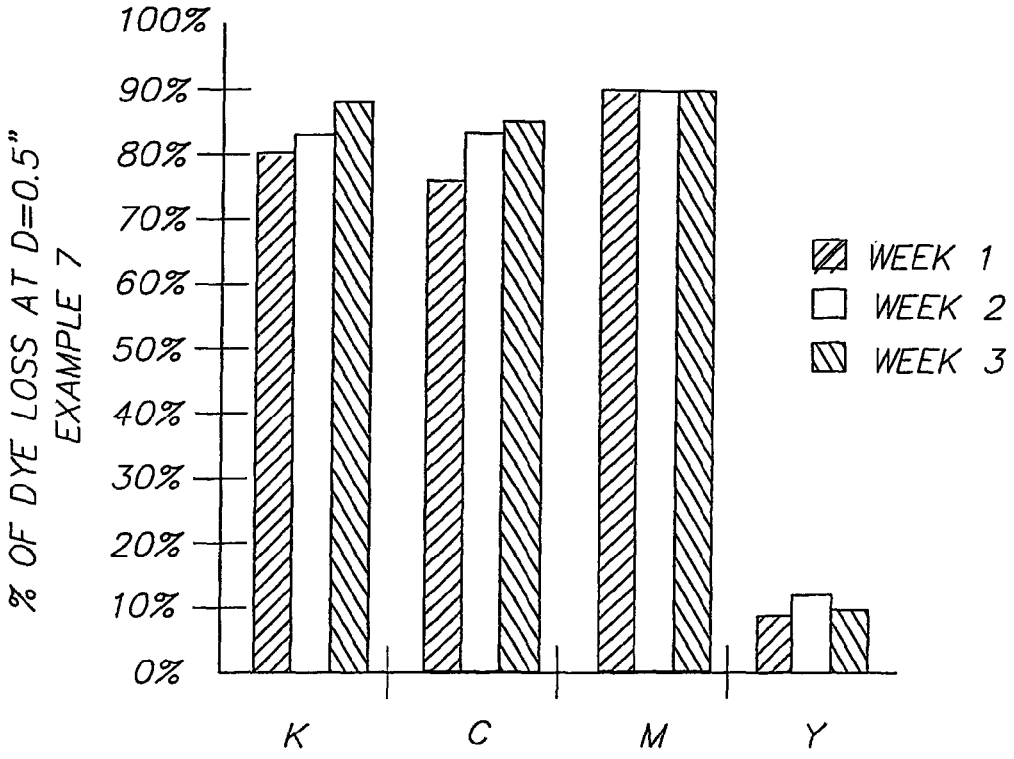
Figure 6:
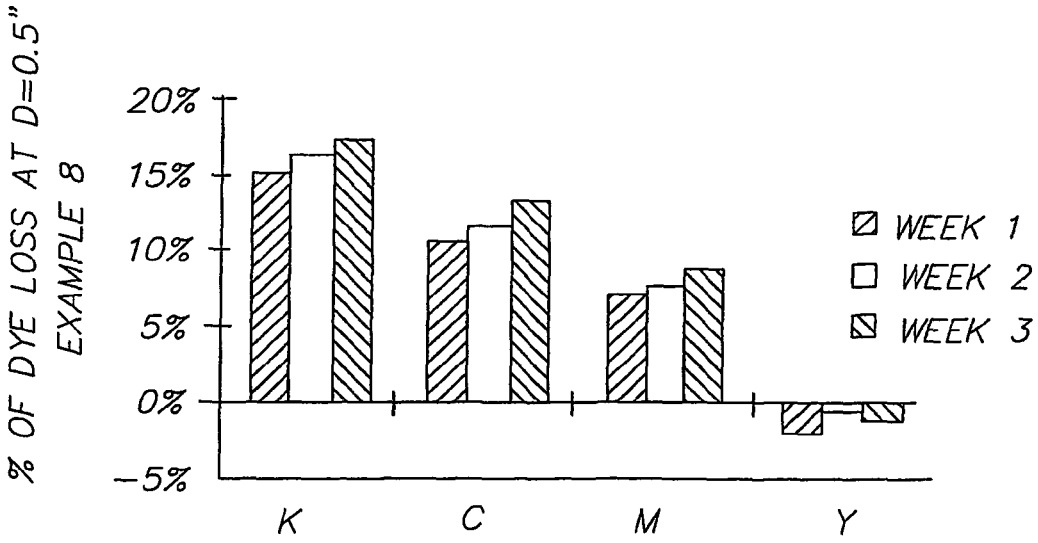
Figure 7:
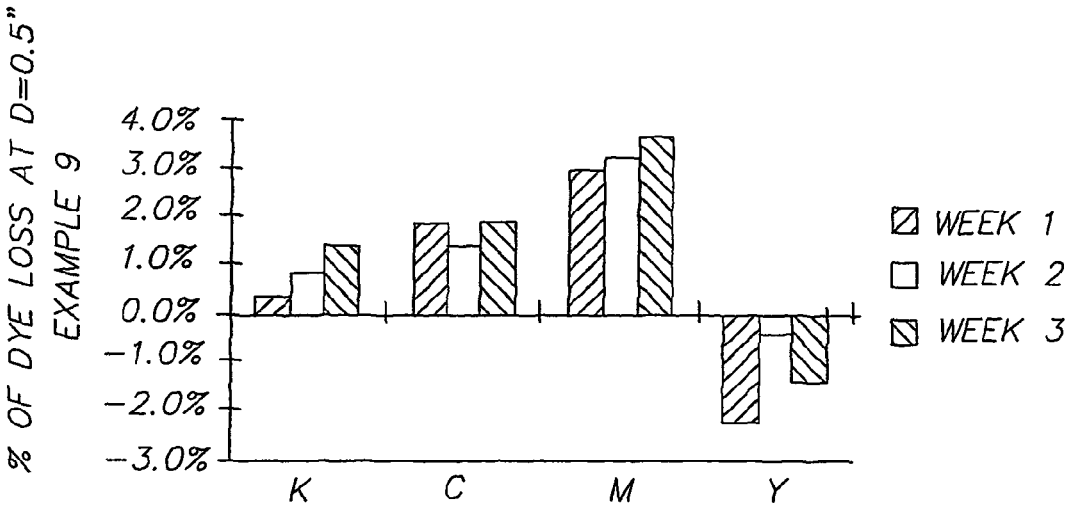
Figure 8:
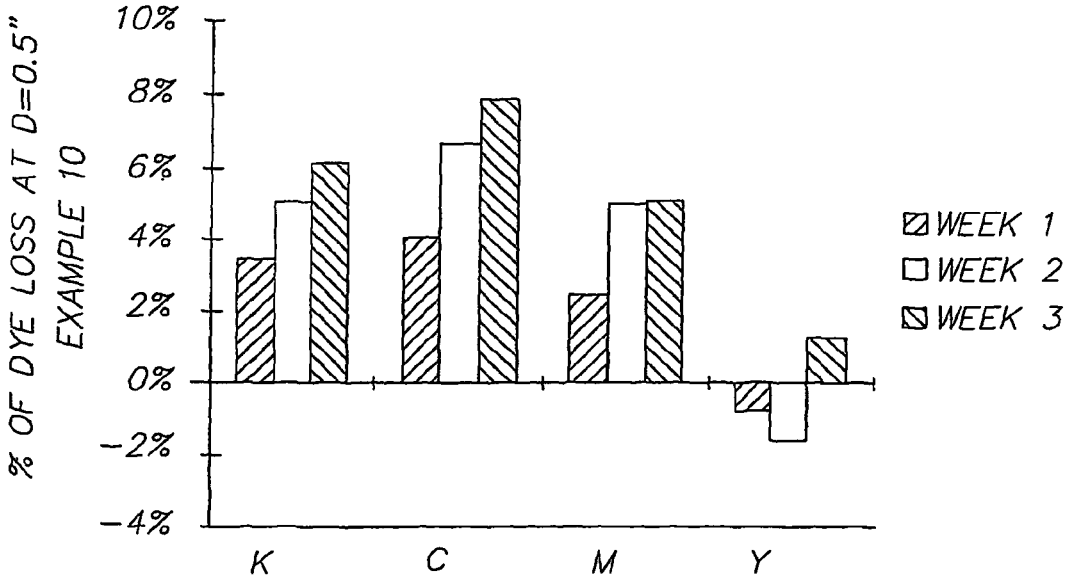
Figure 9:
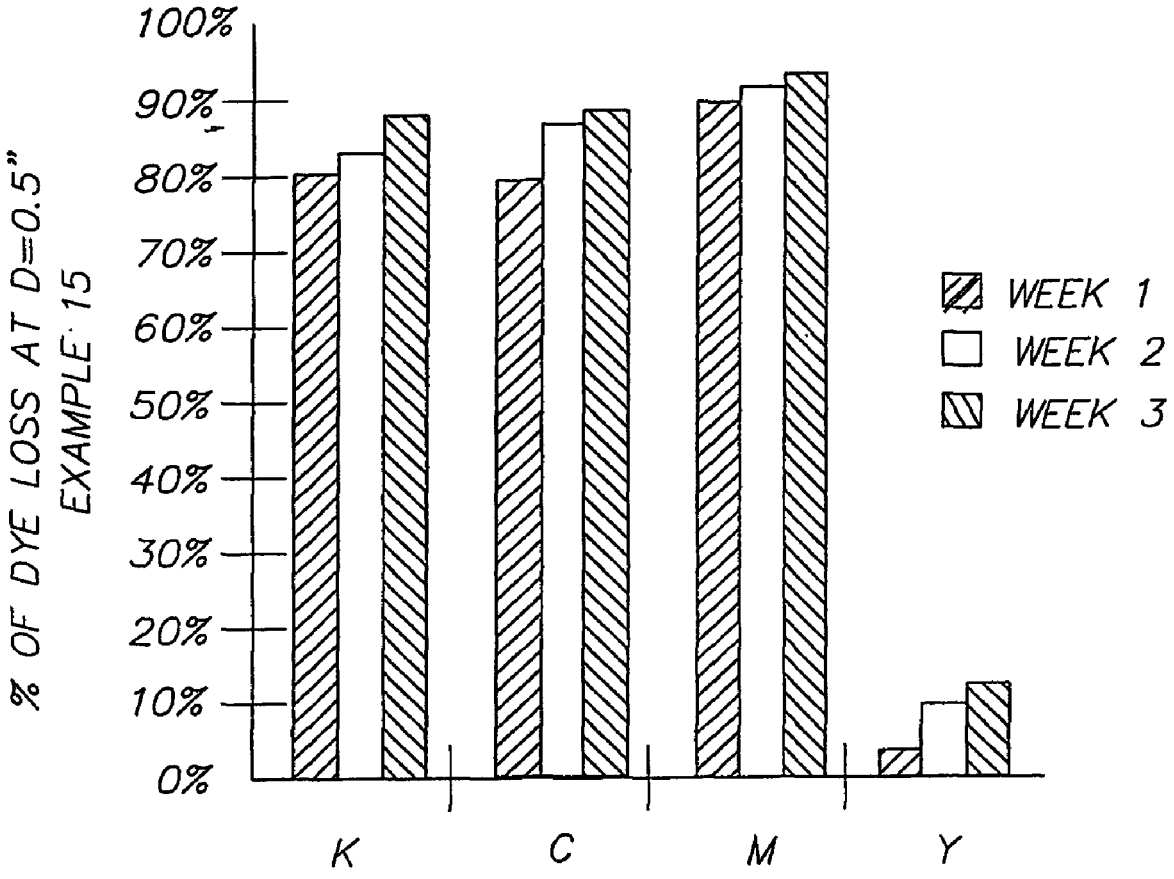

FIG. 4 represents the percentage of density loss observed for the original density 0.5 for the four colors of the targets after one week for examples 11, 12, 13 and 14. Letters K, C, M and Y represent the colors black, cyan, magenta and yellow respectively.

It may be seen that the ink jet recording elements according to the invention (Ex 11 and 12) have much better dye keeping properties in time than that observed for the recording elements containing other inorganic receiving agents available on the market (Ex 13 and 14).

FIGS. 5 to 9 represent the percentage of density loss observed for the original density 0.5 for the four colors of the targets after three week for examples 7, 8, 9, 10 and 15 respectively. Once again, the figures clearly demonstrate that the recording elements according to the invention (Ex 8 to 10 corresponding to FIGS. 6 to 8) have much better dye keeping properties than that observed for the recording elements containing the inorganic receiving agents available on the market (Ex 7 and 15) and are stable for all the colors. However, up to 90 percent density loss may be observed for the colors magenta and cyan for comparative Examples 7 and 15 corresponding to FIGS. 5 and 9.

Figure 10:
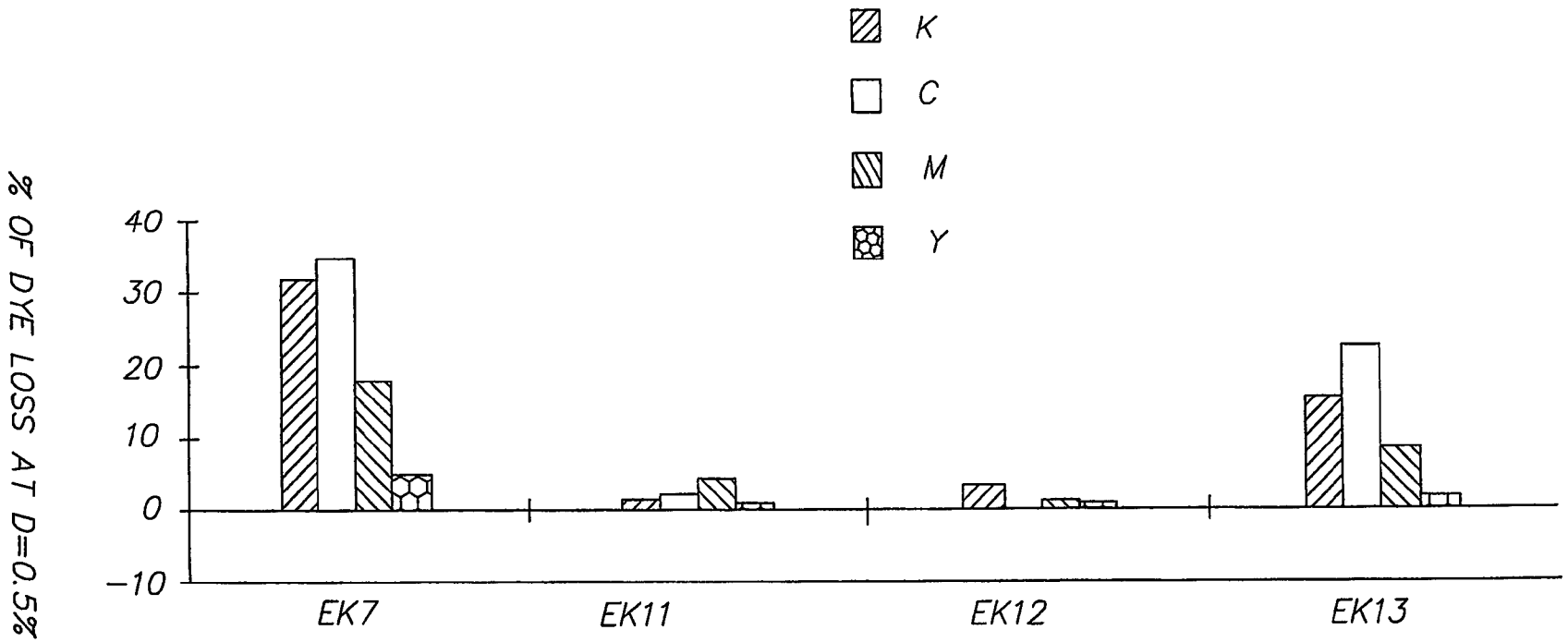

The tests were repeated using an Epson 670 printer and the related Epson ink for the recording elements of examples 7, 11, 12 and 13. FIG. 10 represents the percentage of density loss observed for the original density 0.5 for the four colors of the targets after one week for said examples 7, 11, 12 and 13 respectively. The colors of the recording elements according to the invention (Ex 11 and 12) are particularly stable compared with the recording elements of comparative examples 7 and 13.

5) Evaluation of the Gloss

Gloss was measured for various resulting recording elements using a Picogloss 560 apparatus (60° geometry) marketed by Erichsen.

The results are given below in Table II.

TABLE II

| Recording element | Gloss (percent) |
|---|---|
| Ex 7 (comp.) | 2 |
| Ex 11 (inv.) | 60 |
| Ex 12 (inv.) | 55 |

The results of Table II show that the recording elements according to the present invention show a good gloss, which is wanted to reproduce the gloss of photographs developed by a conventional silver process.

6) Preparation of a Coating Composition Constituting an Ink-Receiving Layer Coated on a Support

EXAMPLE 16

Glacial acetic acid (340 mg, 5.6 mmol) was added to 20 g of a gel of methyl hybrid aluminosilicate polymer (Al amount=75 mg, 2.8 mmol, measured by inductively coupled plasma atomic emission spectroscopy, ICP) as obtained in Example 5. The mixture was stirred during 2 days. The excess of water and the unreacted acetic acid were removed by evacuation under vacuum at 35° C. 4.4 g of a white powder is obtained. The Raman spectrum comprises the bands of the hybrid aluminosilicate polymer obtained in Example 5, as well as the bands corresponding to the chelating agent in its acetate form.

As hydrosoluble binder of polyvinylic alcohol (Gohsenol™ GH23 marketed by Nippon Gohsei) diluted 9 percent in osmosed water and as receiving agent the aluminosilicate polymers prepared as above were used.

The composition resulted from mixing:

10.1 g water 2 g receiving agent (dry matter)

2.7 g polyvinylic alcohol.

When the receiving agent has powder form, the particles must first be crushed finely. The mixture is sheared overnight.

EXAMPLE 17

1 g of the hybrid aluminosilicate polymer modified with acetic acid obtained in Example 16 (Al amount=16.2 mg, 0.6 mmole) was dispersed in 10 g of water. Benzoic acid (38 mg, 0.3 mmole) was then solubilized in 1 g of ethanol and added to the hybrid aluminosilicate polymer suspension. The mixture was stirred during 2 days. The excess of water was removed under vacuum at 35° C. A white powder was obtained. The Raman spectrum comprises the bands of the hybrid aluminosilicate polymer obtained in Example 5, as well as the bands corresponding to the chelating agent in its benzoate form and residual acetate form.

As hydrosoluble binder of polyvinylic alcohol (Gohsenol™ GH23 marketed by Nippon Gohsei) diluted 9 percent in osmosed water and as receiving agent the aluminosilicate polymers prepared as above were used.

The composition resulted from mixing:

2.91 g water 0.497 g receiving agent (dry matter)

0.708 g polyvinylic alcohol.

When the receiving agent has powder form, the particles must first be crushed finely. The mixture is sheared overnight.

EXAMPLE 18

1 g of the hybrid aluminosilicate polymer modified with acetic acid obtained in Example 16 (Al amount=16.2 mg, 0.6 mmole) was dispersed in 15 g of water. Propionic acid (181 mg, 2.5 mmole) was added to the hybrid aluminosilicate polymer suspension. The mixture was stirred during 2 days. The excess of water and propionic acid was removed under vacuum at 35° C. A white powder was obtained. The Raman spectrum comprises the bands of the hybrid aluminosilicate polymer obtained in Example 5, as well as the bands corresponding to the chelating agent in its propionate form and residual acetate form.

As hydrosoluble binder of polyvinylic alcohol (Gohsenol™ GH23 marketed by Nippon Gohsei) diluted 9 percent in osmosed water and as receiving agent the aluminosilicate polymers prepared as above were used.

The composition resulted from mixing:

3.11 g water 0.60 g receiving agent (dry matter)

0.83 g polyvinylic alcohol.

When the receiving agent has powder form, the particles must first be crushed finely. The mixture is sheared overnight.

EXAMPLE 19

In this example, the chelating agent of aluminum is added when the coating composition is prepared. As hydrosoluble binder of polyvinylic alcohol (Gohsenol™ GH23 marketed by Nippon Gohsei) diluted 9 percent in osmosed water and as receiving agent the aluminosilicate polymer prepared according to example 5 were used. The chelating agent is acetic acid. The composition resulted from mixing:

7.93 g osmosed water
2.17 glacial acetic acid (36.2 mmol)
2 g receiving agent (dry matter, Al amount=0.49 mg, 18.2 mmol)
2.7 g polyvinylic alcohol.

When the receiving agent has powder form, the particles must first be crushed finely. The mixture was sheared overnight.

7) Preparation of Ink Jet Recording Element

A Resin Coated Paper type support was placed on a coating machine, first coated with a very thin gelatin layer, and held on the coating machine by vacuum. This support was coated with a composition as prepared according to paragraph 6 using a blade. The wet thickness was 200 μm. Then, it was left to dry 3 hours at ambient air temperature (21° C.).

The resulting recording elements correspond to the examples shown in Table III below giving the receiving agent used in the ink-receiving layer:

TABLE III

| Recording Element | Receiving agent in the ink-receiving layer |
|---|---|
| Ex 20 (inv.) | Aluminosilicate prepared according to Example 16 |
| Ex 21 (inv.) | Aluminosilicate prepared according to Example 17 |
| Ex 22 (inv.) | Aluminosilicate prepared according to Example 18 |
| Ex 23 (inv.) | Aluminosilicate prepared according to Example 19 |

8) Evaluation of Dye Keeping Properties in Time

The evaluation of dye keeping properties was made as in paragraph 4 for Example 23.

Figure 11:
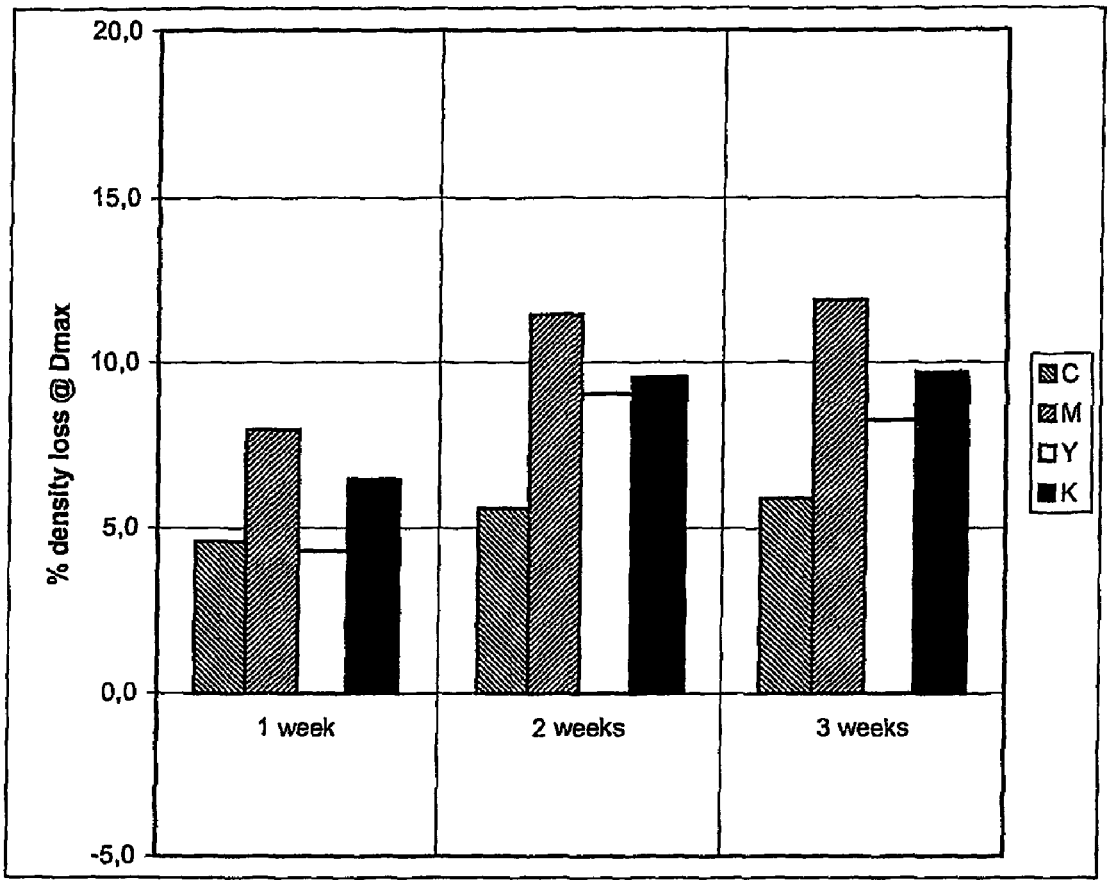
Figure 12:
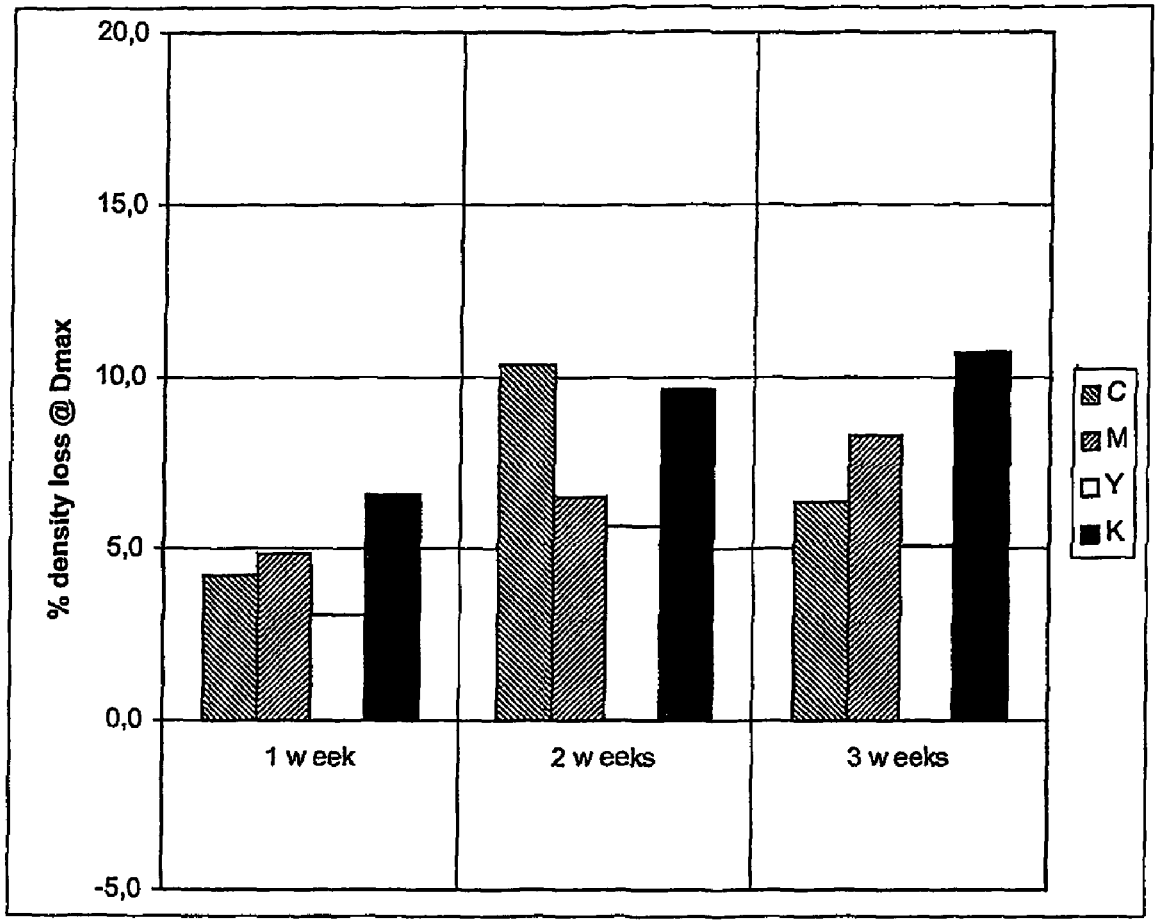

FIGS. 11 and 12 represent the percentage of density loss observed for the maximum density for the four colors of the target for each week for Example 23 printed using the Lexmark Kodak PPM200 printer and related ink and a Epson 890 printer and related ink respectively. Letter C, M, Y and K represent the colors cyan, magenta, yellow and black respectively.

The figures clearly demonstrate that the recording element according to the invention has very good dye keeping properties.

9) Evaluation of the Gloss

Evaluation of the gloss was made as in paragraph 5 for Examples 20-23.

The results are given below in Table IV.

TABLE IV

| Recording element | Gloss (percent) |
|---|---|
| Ex 20 (inv.) | 30 |
| Ex 21 (inv.) | 89 |
| Ex 22 (inv.) | 90 |
| Ex. 23 (inv.) | 86 |

The results of Table IV show that the recording elements according to the present invention show a good gloss, which is wanted to reproduce the gloss of photographs developed by a conventional silver process.

The invention claimed is:

1. An ink jet recording element comprising a support and at least one ink-receiving layer, wherein said ink-receiving layer comprises at least one hydrosoluble binder and at least one hybrid aluminosilicate polymer obtained by a preparation method that comprises the following steps:

a) treating a mixed aluminum and silicon alkoxide of which the silicon has both hydrolyzable substituents and a non-hydrolyzable substituent, or a mixed aluminum and silicon precursor resulting from the hydrolysis of a mixture of aluminum compounds and silicon compounds only having hydrolyzable substituents and silicon compounds having a non-hydrolyzable substituent, with an aqueous alkali, in the presence of silanol groups, the aluminum concentration being maintained at a concentration from $1.4\times10^{-2}$ to 0.3 mol/l, the Al/Si molar ratio being maintained between 1 and 3.6 and the alkali/Al molar ratio being maintained between 2.3 and 3;

b) stirring the mixture resulting from step a) at a temperature of from 15° C. to 35° C. in the presence of silanol groups long enough to form the hybrid aluminosilicate polymer; and c) eliminating the byproducts formed during steps a) and b) from the reaction medium.

2. The recording element according to claim 1, wherein the alkali of step a) to prepare the hybrid aluminosilicate polymer is selected from the group consisting of sodium hydroxide, potassium hydroxide, lithium hydroxide, diethylamine, and triethylamine.

3. The recording element according to claim 1, wherein the silanol groups used to prepare the hybrid aluminosilicate polymer are supplied in silica or glass bead form.

4. The recording element according to claim 1, wherein the aluminum concentration used to prepare the hybrid aluminosilicate polymer is maintained between $4.3\times10^{-2}$ and 0.3 mol/l.

5. The recording element according to claim 1, wherein said alkali/Al molar ratio to prepare the hybrid aluminosilicate polymer is about 2.3.

6. The recording element according to claim 1, wherein said alkali/Al molar ratio to prepare the hybrid aluminosilicate polymer is about 3.

7. The recording element according to claim 1, wherein the method for preparing the hybrid aluminosilicate polymer comprises, after step b) and before step c), a step d), by which alkali is added in order to reach an alkali/Al molar ratio of 3 if this ratio has not already been reached in step a).

8. The recording element according to claim 1, wherein said mixed aluminum and silicon precursor resulting from hydrolysis of a mixture of aluminum compounds and silicon compounds only having hydrolyzable substituents and silicon compounds having a non-hydrolyzable substituent is a product resulting from the mixture in an aqueous medium (i) of a compound selected from the group consisting of aluminum salts, aluminum alkoxides and aluminum halogenoalkoxides and (ii) at least one compound selected from the group consisting of silicon alkoxides and chloroalkoxides only having hydrolyzable substituents, and (iii) at least one compound selected from the group consisting of silicon alkoxides and chloroalkoxides having a non-hydrolyzable substituent.

9. The recording element according to claim 8, wherein said mixed aluminum and silicon precursor is the product resulting from the mixture (i) of an aluminum halide and (ii) a mixture having at least one silicon alkoxide only having hydrolyzable substituents and at least one silicon alkoxide having a non-hydrolyzable substituent.

10. The recording element according to claim 9, wherein the ratio of silicon alkoxide only having hydrolyzable substituents to silicon alkoxide having a non-hydrolyzable substituent is between 0.1 and 10 in moles silicon.

11. The recording element according to claim 10, wherein the ratio of silicon alkoxide only having hydrolyzable substituents to silicon alkoxide having a non-hydrolyzable substituent is 1 in moles silicon.

12. The recording element according to claim 9, wherein said silicon alkoxide only having hydrolyzable substituents is tetramethyl orthosilicate or tetraethyl orthosilicate.

13. The recording element according to claim 8, wherein the silicon alkoxide having a non-hydrolyzable substituent is represented by the formula $$R'—Si—(OR)3$$

wherein

R represents an alkyl group comprising 1 to 5 carbon atoms

R' represents H, F, or a substituted or unsubstituted non-linear or ramified alkyl or alkenyl group comprising 1 to 8 carbon atoms.

14. The recording element according to claim 13, wherein R' represents a methyl, ethyl, n-propyl, n-butyl, 3-chloropropyl, or vinyl group.

15. The recording element according to claim 14, wherein said silicon alkoxide having a non-hydrolyzable substituent is methyltriethoxysilane or vinyltriethoxysilane.

16. The recording element according to claim 1, wherein the method for preparing the aluminosilicate polymer comprises, after step c), a step e), by which at least one chelating agent of aluminum is added to the hybrid aluminosilicate polymer resulting from step c).

17. The recording element according to claim 16, wherein step e) is applied directly on the hybrid aluminosilicate polymer resulting from step c) to prepare a hybrid aluminosilicate polymer resulting from step e) or when a coating composition for the preparation of the ink-receiving layer is prepared by using a hybrid aluminosilicate polymer resulting from step c).

18. The recording element according to claim 16, wherein said chelating agent of aluminum is selected from the group consisting of carboxylic acids, phosphoric acids, sulfonic acids, difunctional acids, their ester and anhydride components and amino acids.

19. The recording element according to claim 18, wherein said chelating agent of aluminum is selected from the group consisting of HCOOH, $R_1COOH$ wherein $R_1$ is selected from the group consisting of $CH_3(CH_2)_n$, n being between to 0 and 12, $CF_3$, $C_6H_5$, $(C_6H_5)_2$, substituted aromatic rings, $C_4H_4S$; $R_2PO(OH)_2$ wherein $R_2$ is selected from the group consisting of $CH_3$, $C_6H_5$; $R_3SO_3H$ wherein $R_3$ is $CH_3(CH_2)_n$, n being between to 0 and 5; $HOOC(CH_2)_nCOOH$, n=0-8; aromatic difunctional acids; $HOOC(CH_2)_nPO(OH)_2$, n=2, 4; hydroxy aliphatic acids; $HOOC(CH_2OH)_nCOOH$, n=1-2; $CH_3CH(NH_2)COOH$.

20. The recording element according to claim 16, wherein step e) comprises a first adding of acetic acid and a following adding of another different chelating agent of aluminum.

21. The recording element according to claim 16, wherein the amount of the chelating agent in the ink-receiving layer corresponds to a molar ratio between the chelating functions of the chelating agent and aluminum of the hybrid aluminosilicate polymer, and wherein this molar ratio is greater than 0.1.

22. The recording element according to claim 1, wherein said ink-receiving layer comprises between 5 and 95 percent by weight of hybrid aluminosilicate polymer compared with the total weight of the dry ink-receiving layer.

23. The recording element according to claim 1, wherein the hydrophilic binder is gelatin or polyvinyl alcohol.

24. A coating composition for the preparation of ink-receiving layers for the ink jet recording element according to claim 1.

* * * * *

UNITED STATES PATENT AND TRADEMARK OFFICE

CERTIFICATE OF CORRECTION

PATENT NO. : 8,124,220 B2
APPLICATION NO. : 10/521898
DATED : February 28, 2012
INVENTOR(S) : Poncelet et al.

It is certified that error appears in the above-identified patent and that said Letters Patent is hereby corrected as shown below:

In Column 16, line 3 (Claim 18), delete “phosphoric” and insert -- phosphonic --.

Signed and Sealed this
Twenty-ninth Day of January, 2013

David J. Kappos

David J. Kappos
*Director of the United States Patent and Trademark Office*